United States Patent [19]

Belmondo

[11] Patent Number: 5,073,056

[45] Date of Patent: Dec. 17, 1991

[54] MONOLYTHIC CAP FOR WRITING IMPLEMENTS

[75] Inventor: Domenico Belmondo, Borgaro, Italy

[73] Assignee: Dobell S.P.A., Turin, Italy

[21] Appl. No.: 470,824

[22] Filed: Jan. 26, 1990

[30] Foreign Application Priority Data

Apr. 28, 1989 [IT] Italy ..... 53048 B/89

[51] Int. Cl.[5] ..... B43K 5/00; B43K 9/00

[52] U.S. Cl. ..... 401/202; 401/213; 401/243

[58] Field of Search ..... 401/202, 213, 243; D19/57

[56] References Cited

FOREIGN PATENT DOCUMENTS

| | | | |
|---|---|---|---|
| 0204252 | 12/1986 | European Pat. Off. | 401/202 |
| 330877 | 9/1989 | European Pat. Off. | 401/213 |
| 3728896 | 11/1988 | Fed. Rep. of Germany | 401/202 |
| 6111016 | 6/1983 | Japan | 401/213 |
| 2174374 | 11/1986 | United Kingdom | 401/243 |

*Primary Examiner*—Robert Bahr
*Assistant Examiner*—D. F. Crosby
*Attorney, Agent, or Firm*—Merchant & Gould, Smith, Edell, Welter & Schmidt

[57] ABSTRACT

A cap for writing implements comprises a hollow lower body jointed at one end to a hollow upper body, ending on top with a closed end having a smaller section; openings for the communication of the lower inner hollow body with the outside are obtained in correspondence with the jointed length; said openings alternate to sides extending from said jointed length, which are substantially parallel to the hollow upper body to form ducts stretching out towards said closed end where further communication openings are realized between the inner lower hollow body and the outside.

4 Claims, 1 Drawing Sheet

MONOLYTHIC CAP FOR WRITING IMPLEMENTS

DESCRIPTION

The invention refers to a monolythic cap for writing implements equipped with two sets of ducts protected towards the outside, able to allow the passage of air through said cap.

BACKGROUND

Caps for writing implements such as pens, felt tip pens and similar that carry ducts and/or holes to allow the passage from the inside to the outside of their body are already on the market.

In case the cap is accidentally swollen and stops in the pharynx, the holes and/or ducts allow the victim of the accident to breathe sufficient air until the intervention of a physician who will remove the cap from the pharynx, or perform a tracheotomy if it is impossible to remove the cap easily and immediately. The caps found on the market at the moment offer some safety systems; however, the air passage openings are obtained only in the midway outer part of the cap or on the closed upper end.

In this way, the incoveniences are two: the total area for the air passage through the openings is insufficient for the desired safety; as the openings are only found at a single particular position along the length of the cap, the air passage would become insufficient to ensure the desired safety if the trachea sides should adhere to that position, or if some substances should accumulate and occlude the openings even only partially.

SUMMARY OF THE INVENTION

Purpose of the invention is to avoid the above inconveniences by providing a cap equipped with two sets of ducts and openings arranged at two different positions along the length of the cap thereby allowing greater air passage area through the cap. Having ducts located at two positions along the length of the cap is advantageous because one set of ducts will provide sufficient air passage to ensure the safety effect in case one set of ducts, or part thereof, is accidentally occluded.

For these and other purposes which will be better appreciated from the following description, the invention proposes a cap for writing implements. The cap includes a hollow lower body joined at one end to a hollow upper body, terminating on top with a closed end having a smaller section; openings for the communication of the lower inner hollow body with the atmosphere are obtained as a result of the structure of the joint between the hollow lower body and the hollow upper body. The openings alternate to sides extending from said jointed length, which are sustantially parallel to the hollow upper body to form ducts stretching out towards said closed end where further communication openings are realized between the inner lower hollow body and the outside.

BRIEF DESCRIPTION OF DRAWINGS

The cap of the invention is now being described and reference is made to the attached drawings.

DESCRIPTION OF THE PREFERRED EMBODIMENT

Figure 1:
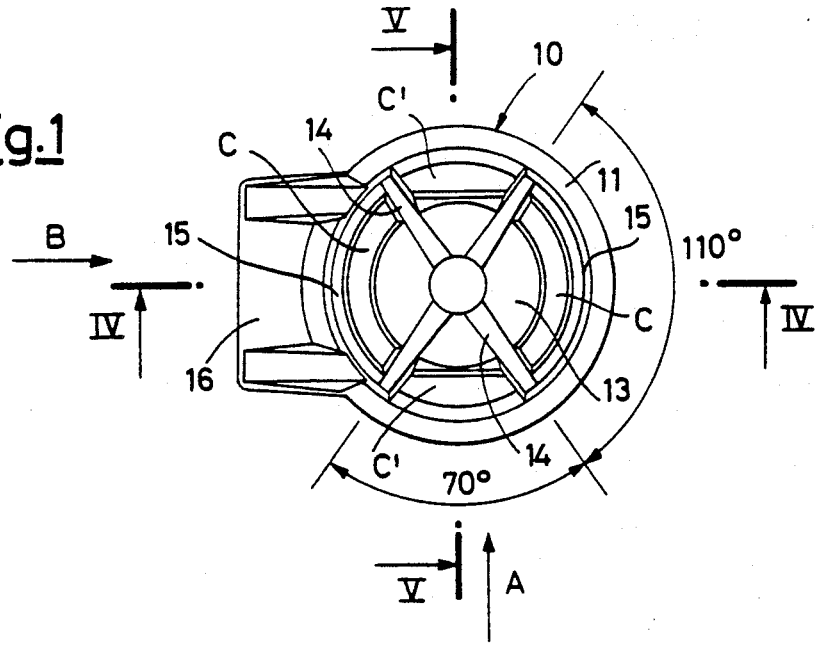
FIG. 1 is the plan view from top of the cap of the invention.
Figure 2:
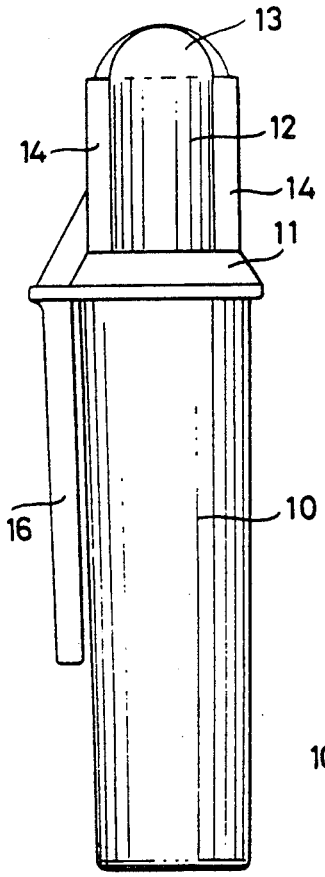
FIGS. 2 and 3 are respectively the views according to arrows A and B of the cap of FIG. 1.
Figure 3:
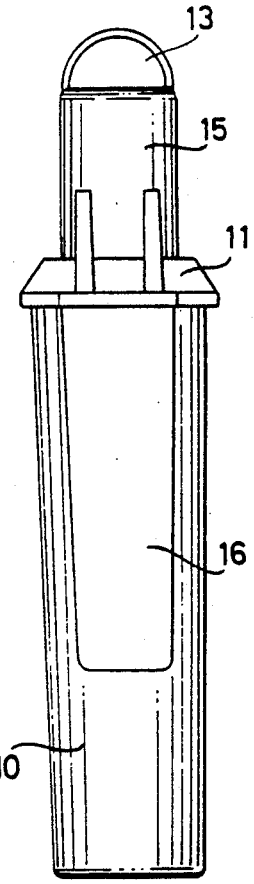

The cap of the invention includes a cylindrical lower hollow body 10 joined, in correspondence with a collar 11, to a second cylindrical body 12 having a smaller diameter than the first body 10 and being closed on top at 13. A chamber is thus defined by the cylindrical body 12, generally sized to firmly receive with the point of the writing implement to prevent or inhibit evaporation of the solvent of the writing substance or the drying up of said substance.

Four tongues 14 extend radially from the upper body and are attached to two arched sides 15 diametrically opposed to each other and integral to the collar 11 thus realizing the wholeness of the cap.

As illustrated in the drawings, the sides 15 extend in parallel to the surface of the upper body 12. The sides 15 terminate at a first position along the length of the cap that is generally proximate to the closed end 13.

Figure 4:
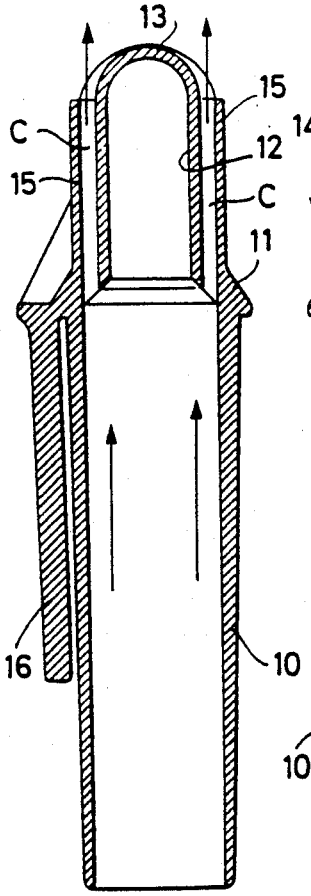
FIGS. 4 and 5 are respectively sections taken along lines IV—IV and V—V, respectively of the cap of FIG. 1.

Two ducts C are defined in this way between the outer surface of the upper body 12 and the sides 15; said ducts are located diametrically opposed to each other about the circumference of the cap. The ducts allow fluid communication between the inside of the body 10 and the outside, or atmosphere near the end 13 of the cap, as indicated by the arrows of FIG. 4. Each of the ducts C is generally arc-shaped in cross-section and extend through arc of about 110 degrees, as illustrated in FIG. 1.

Figure 5:
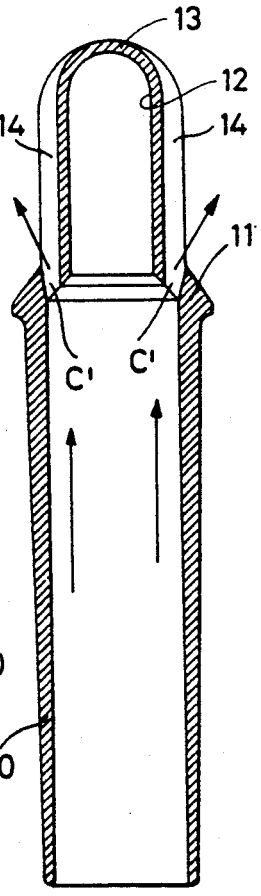

A second set of ducts is further provided in the cap of the present invention. Two ducts C′ are defined by collar 11 are and the outer surface of the upper body 12. They also diametrically opposed to each other and interposed between the previously mentioned ones. The second set of ducts allow fluid communication between the inside of the body 10 and the outside, or atmosphere near the collar as indicated by the arrows of FIG. 5. This second set of ducts terminates at a second position along the length of the cap that is generally spaced longitudinally from the first position.

These latter ducts, or second set of ducts, are generally arc-shaped in cross-section and extend preferably through an arc of about 70 degrees each, as illustrated in FIG. 1, so that the entire circumference of the cap will be associated with air openings, communicating air between its inner part and the outside. The first and second set of ducts communicate with the atmosphere at different planes, i.e. at different positions along the length of the cap The design of the openings allows the greatest possible surface area for the air passage through the cap, such area being absolutely greater than the one found in any other cap on the market at the moment. Should a pair of said ducts be for any reason occluded, the other pair would ensure sufficient air breathing for the survival of the patient until the physician's intervention, as the openings are positioned on two different lengths of the cap.

The above described cap illustrated in the attached drawings may have any shape and dimension, and the clip 16 may or may not be assembled on it, and nothing will vary as regards the safeguard of the invention as represented by the following claims.

I claim:

1. A cap for writing implements characterized in that it comprises a lower hollow body, joined at one end to a hollow upper body and having its top end closed and with a smaller diameter than the lower body; openings for fluid communication between the inside of the lower hollow body with the atmosphere being located in correspondence of a collar that joints said upper and lower hollow bodies; said openings being disposed alternately with tongues and sides extending upwardly from said collar and that are substantially parallel to the upper hollow body so as to define ducts between the sides and the outside of the upper hollow body, said ducts extending towards said closed end and terminating in a second set of openings for fluid communication between the lower hollow body with the atmosphere.

2. A cap according to claim 1 wherein the openings located in correspondence with the collar are located on diametrally opposite sides of said cap to each other, and said ducts alternate around the cap's circumference with said openings.

3. A cap according to claim 2 wherein the openings and the ducts each extend through an arc of a circle and collectively, the openings and ducts cover substantially 360 degrees of the circumference of the cap.

4. A cap, defining an interior cavity, for a writing instrument adapted to prevent suffocation if swallowed, comprising:

a.) a lower generally cylindrical body having first and second opposite ends; said first end being open, thereby allowing fluid communication between the interior cavity of said cap and the atmosphere;

b.) an upper generally cylindrical body, having a first end attached to said second end of said lower body, and a second opposite end that is generally closed against fluid communication between the interior cavity of said cap and the atmosphere;

c.) first means for fluid communication between the inside of said cap and the atmosphere, said first fluid communication means including ducts comprising tongues and sides terminating at a first position along the length of the cap at a position proximate said upper body second end;

d.) second means for fluid communication between the inside of said cap and the atmosphere, said fluid communication means terminating at a second position along the length of the cap at a position spaced longitudinally from said first position.

* * * * *

UNITED STATES PATENT AND TRADEMARK OFFICE

CERTIFICATE OF CORRECTION

PATENT NO. : 5,073,056

DATED : 17 December 1991

INVENTOR(S) : Domenico Belmondo

It is certified that error appears in the above-identified patent and that said Letters Patent is hereby corrected as shown below:

Abstract, line 3 delete "ending" and insert --terminating--.

Abstract, line 6 delete "outside" and insert --atmosphere--.

Abstract, line 6&7 delete "in correspondence with the joined length; said" after the word "obtained" and insert --as a result of the structure of the joint between the hollow lower body and the hollow upper body. The--.

Column 1, line 37 delete "Purpose" and insert --The purpose--.

Column 2, line 32 insert --an-- after the word "through".

Column 2, line 36 delete "are" after the numeral "11".

Column 2, line 37 insert --are-- after the word "They".

Signed and Sealed this

Third Day of August, 1993

*Attest:*

Michael K. Kirk

MICHAEL K. KIRK

*Attesting Officer*

*Acting Commissioner of Patents and Trademarks*